US007341044B1

(12) United States Patent
Bayer et al.

(10) Patent No.: US 7,341,044 B1
(45) Date of Patent: Mar. 11, 2008

(54) METHOD AND CONTROL DEVICE FOR REGULATING THE AIR-FUEL MIXTURE PROVIDED TO AN ENGINE

(75) Inventors: Don R. Bayer, Dousman, WI (US); Christine A. Richardson, Delavan, WI (US); Guoming Wu, Waukesha, WI (US); Robert D. Kern, Waukesha, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 0 days.

(21) Appl. No.: 11/622,278

(22) Filed: Jan. 11, 2007

(51) Int. Cl.
*F02D 9/00* (2006.01)

(52) U.S. Cl. ..... 123/438; 123/402

(58) Field of Classification Search ..... 123/437, 123/438, 324, 344, 402
See application file for complete search history.

(56) References Cited

U.S. PATENT DOCUMENTS

| | | | | |
|---|---|---|---|---|
| 5,500,159 | A * | 3/1996 | Martinsson | 261/52 |
| 5,611,312 | A * | 3/1997 | Swanson et al. | 123/438 |
| 5,992,381 | A * | 11/1999 | Aubourg | 123/344 |
| 2006/0037574 | A1* | 2/2006 | Matsuda et al. | 123/179.18 |
| 2006/0042595 | A1* | 3/2006 | Matsuda | 123/438 |
| 2007/0131200 | A1* | 6/2007 | Matsuda et al. | 123/438 |

* cited by examiner

*Primary Examiner*—Erick Solis

(57) ABSTRACT

A method and device is provided for regulating the air-fuel mixture provided to an engine of a stand-by electrical generator during the exercise thereof. The engine is exercised at a predetermined speed less than the normal operating speed of the engine and each cylinder receives an air-fuel mixture having an air component and a fuel component. To exercise the engine, the air component and the fuel component in the air-fuel mixture provided to the engine is reduced. In addition, the volume of the air-fuel mixture provided to each cylinder of the engine is balanced.

22 Claims, 4 Drawing Sheets

METHOD AND CONTROL DEVICE FOR REGULATING THE AIR-FUEL MIXTURE PROVIDED TO AN ENGINE

FIELD OF THE INVENTION

This invention relates generally to engine-driven, electrical generators, and in particular, to a fuel mixer box incorporating a control device for regulating the air-fuel mixture provided to an engine of a stand-by electrical generator during the exercise thereof.

BACKGROUND AND SUMMARY OF THE INVENTION

Electrical generators are used in a wide variety of applications. Typically, an individual electrical generator operates in a stand-by mode wherein the electrical power provided by a utility is monitored such that if the commercial electrical power from the utility fails, the engine of the electrical generator is automatically started causing the alternator to generate electrical power. When the electrical power generated by the alternator reaches a predetermined voltage and frequency desired by the customer, a transfer switch transfers the load imposed by the customer from the commercial power lines to the electrical generator.

As is known, engine-driven, electrical generators are often exercised to insure proper operation when their use is required. In order to exercise the engine-driven, electrical generator, the engine is either automatically or manually started and runs for a predetermined time period at its full operating speed. It can be appreciated that any operation of the engine-driven, electrical generator can produce unwanted noise. This, in turn, may discourage a user from exercising their electrical generator in a timely manner. Further, due to various local ordinances, it has become highly desirable to reduce the noise associated with exercising a stand-by electrical generator.

One option for reducing the noise associated with exercising a stand-by electrical generator is to operate the electrical generator at a lower engine speed. It can be appreciated that there are certain inherent problems associated with operating an engine at speeds below the normal operating speed. Typically, the speed of the engine is slowed by reducing the air-fuel mixture supplied to the cylinders of the engine. However, it is difficult to balance the air-fuel mixture provided to each cylinder of the engine. As a result, the performance of the engine suffers. Further, there may be additional emissions associated with operation of the engine at a low speed.

Therefore, it is a primary object and feature of the present invention to provide a fuel mixer box incorporating a control device for regulating the air-fuel mixture provided to a stand-by electrical generator during the exercise thereof.

It is a further object and feature of the present invention to provide a fuel mixer box incorporating a control device for regulating the air-fuel mixture provided to a stand-by electrical generator during the exercise thereof such that the stand-by electrical generator generates less noise than during prior exercise methods.

It is a still further object and feature of the present invention to provide a fuel mixer box incorporating a control device for regulating the air-fuel mixture provided to a stand-by electrical generator during the exercise thereof that is simple to operate and inexpensive to manufacture.

In accordance with the present invention, a device is provided for balancing a fuel mixture provided to each cylinder of an engine during the exercise of the engine. The device includes first and second input conduits. Each input conduit has an input connectable to a fuel source for receiving fuel therefrom and an output. First and second output conduits have inputs communicating with the outputs of corresponding first and second input conduits and outputs connectable to corresponding cylinders of the engine. A housing has an interior and an opening therein for allowing air to enter the housing. The housing includes a first fuel mixture chamber interconnecting the output of the first input conduit and the input of the first output conduit. The first fuel mixture chamber has an input communicating with the interior of the housing. The housing also includes a second fuel mixture chamber interconnecting the output of the second input conduit and the input of the second output conduit. The second fuel mixture chamber has an input communicating with the interior of the housing. A balancing device is positioned in the housing for selectively controlling the flow of air from the interior of the housing into the first fuel mixture chamber.

The balancing device may also selectively control the fuel flowing in at least one of the first and second input conduits. The balancing device includes a valve plate pivotably mounted within the housing. The valve plate is movable between a first open position and a second exercise position wherein the valve plate overlaps at least a portion of the input of the first fuel mixture chamber. The balancing device may also include a rotatable shaft operatively connected to the valve plate and extending into the first input conduit. The shaft is movable between a first open position for allowing a first volume of fuel to flow therepast and a second exercise position for allowing a second volume of fuel to therepast. It is contemplated for the first volume to be greater than the second volume. The shaft includes an aperture therethrough. The fuel flows around the shaft with shaft in the open position and through the aperture in the shaft with the shaft in the exercise position.

The fuel mixer box may also include a solenoid having an extendable plunger operatively connected to the valve plate for moving the valve plate. The solenoid is movable between a first retracted position to maintain the valve plate in the open position and an extended position for maintaining the valve plate in the exercise position. An adjustment device is operatively connected to the valve plate for setting the exercise position of valve device. A stop plate projects into the interior of the housing. The adjustment device includes a support projecting from the valve plate. The support has a threaded aperture therethrough. A screw extends through the threaded aperture. The screw includes a shaft having a terminal end that engages the stop plate so as to define the exercise position of the valve plate.

In accordance with a further aspect of the present invention, a fuel mixer box is provided for balancing a fuel mixture provided to each cylinder of an engine during the exercise of the engine. The fuel mixer box includes a first input conduit having an input connectable to a fuel source for receiving fuel therefrom and an output. A first output conduit has an input communicating with the output of the first input conduit and an output connectable to a first cylinder of the engine. A second input conduit has an input connectable to the fuel source for receiving fuel therefrom and an output. A second output conduit has an input communicating with the output of the second input conduit and an output connectable to a second cylinder of the engine. A housing defines an inner chamber and an opening therein for receiving air. The housing includes first and second fuel mixture chambers. The first fuel mixture chamber interconnects the output of the first input conduit and the input of the first output conduit. The first fuel mixture chamber has an input communicating with the inner chamber of the housing. The second fuel mixture chamber interconnects the output of the second input conduit and the input of the second output conduit. The second fuel mixture chamber has an input communicating with the inner chamber of the housing. A valve plate is pivotably mounted within the housing. The valve plate is movable between a first open position and a second exercise position wherein the valve plate overlaps at least a portion of the input of the first fuel mixture chamber. A fuel control element extends into the first input conduit. The fuel control element is movable between a first open position for allowing a first volume of fuel to flow therepast and a second exercise position for allowing a second volume of fuel to therepast.

The fuel control element is operatively connected to the valve plate for pivotable movement therewith. The fuel control element includes a rotatable shaft operatively connected to the valve plate and having an aperture therethrough. The fuel flows around the shaft with the fuel control element in the open position and the fuel flows through the aperture in the shaft with the fuel control element in the exercise position.

The fuel mixer box may also include a solenoid having an extendable plunger operatively connected to the valve plate for pivoting the valve plate. The solenoid is movable between a first retracted position to maintain the valve plate in the open position and an extended position for maintaining the valve plate in the exercise position. An adjustment device is operatively connected to the valve plate for defining the exercise position of the valve device. A stop plate projects into the interior of the housing. The adjustment device includes a support projecting from the valve plate and a screw. The support has a threaded aperture therethrough. The screw extends through the threaded aperture and includes a shaft having a terminal end. The terminal end of the shaft engages the stop plate so as to define the exercise position of the valve plate.

In accordance with a still further aspect of the present invention, a method is provided for exercising an engine having a plurality of cylinders at a predetermined speed less than the normal operating speed of the engine. Each cylinder receives an air-fuel mixture having an air component and a fuel component. The method includes the step of reducing the air component and the fuel component in the air-fuel mixture. Thereafter, the volume of the air-fuel mixture provided to each cylinder of the engine is balanced.

The step of reducing the air component includes steps of providing an input having a cross-sectional area for receiving the air component of the air-fuel mixture and reducing the cross-sectional area of the input. The step of reducing the cross-sectional area of the input includes the step of providing a valve plate. The valve plate is in a non-interfering relationship with the input of the engine. The valve plate is pivoted to an exercise position wherein the valve plate overlaps at least a portion of the input.

It is contemplated for the method to include the additional step of adjusting the exercise position of the valve plate and for the step of reducing the fuel component to include the steps of providing an input having a cross-sectional area for receiving the fuel component of the air-fuel mixture and reducing the cross-sectional area of the input. The input for the fuel is defined by a fuel conduit having a passageway with a cross-sectional area. The step of reducing the cross-sectional area of the input includes the steps of providing a fuel control element in the fuel conduit and rotating the fuel control element to an exercising position to reduce the cross-sectional area of the passageway.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
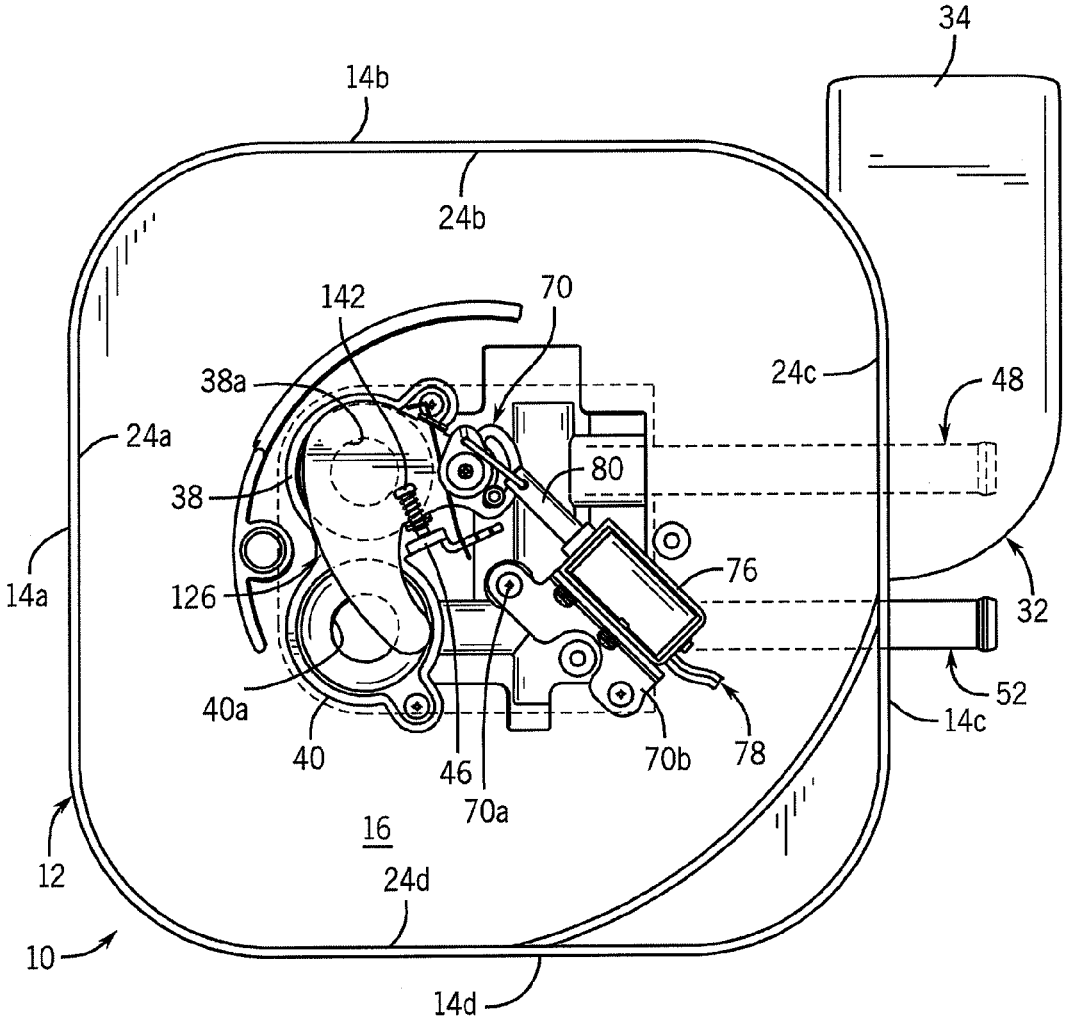
FIG. 1 is a top plan view of a fuel mixer box in accordance with the present invention.
Figure 2:
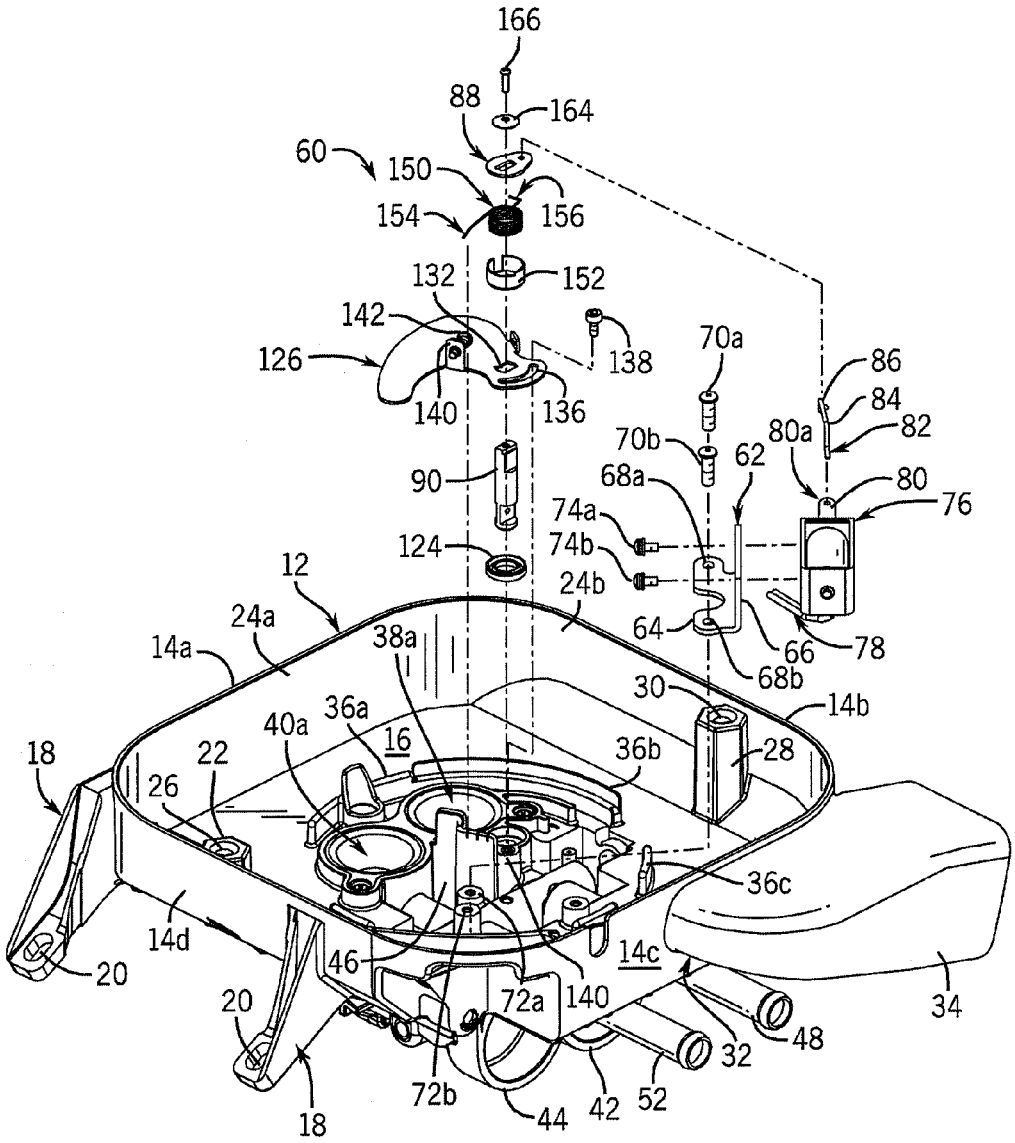
FIG. 2 is an exploded, isometric view of the fuel mix box of FIG. 1.

Referring to FIGS. 1 and 2, a fuel mixer box in accordance with the present invention is generally designated by the reference numeral 10. It is intended for fuel mixer box 10 to be mounted on a conventional internal combustion engine (not shown) of a conventional stand-by electrical generator. In addition, as hereinafter described, fuel mixer box 10 is operatively connected to a fuel demand regulator. By way of example, the fuel demand regulator make take the form of the fuel demand regulator fully described in U.S. patent application Ser. No. 09/749,363, entitled "Fuel Demand Regulator," assigned to the assignee of the present application and incorporated herein by reference.

Fuel mixer box 10 includes housing 12 adapted for receiving a cover (not shown) thereon. Housing 12 is defined by vertical sidewalls 14*a*-14*d* and by horizontal lower wall 16. A plurality of legs 18 projects from the outer periphery of housing 12. Apertures 20 extend through the terminal ends of legs IS to facilitate the mounting of housing 12 to the engine. Housing 12 also includes a generally cylindrical vertical tube 22 positioned adjacent to and interconnected to inner face 24*d* of sidewall 14*d*. Tube 22 includes threaded bore 26 therethrough to facilitate the connection of the cover to housing 12. In addition, generally cylindrical tube 28 is positioned adjacent to and interconnected to inner face 24*b* of sidewall 14*b*. Tube 28 includes threaded bore 30 therein to facilitate the connection of the cover to housing 12.

Sidewall 14*c* of housing 12 includes an opening (not shown) therein for communicating with first end 32 of duct 34. A second, opposite end of duct 34 communicates with the outputs of corresponding breathers, respectively. As is conventional, the breathers are mountable on corresponding cylinder heads of a crankcase of the internal combustion engine in order to separate oil from the combustion gases that may pass between the piston rings and the cylinder walls of the cylinders that house the pistons during operation of the internal combustion engine.

A plurality of vertical walls 36*a*-36*c* project from upper surface 16*a* of wall 16 of housing 12. Vertical walls 36*a*-36*c* are generally arcuate and positioned radially inward from the inner faces 24*a*-24*d* of sidewalls 14*a*-14*d*, respectively.

Vertical walls 36*a*-36*c* are intended to align a filter element (not shown) positioned within housing 12.

First and second generally tubular combustion gas conduits 38 and 40, respectively, extend through lower wall 16 of housing 12 and define corresponding passageways 38*a* and 40*a*, respectively. The input of passageway 38*a* of first combustion gas conduit 38 communicates with the interior of housing 12 and the output of passageway 38*a* communicates with the input of a passageway through first output conduit 42. Similarly, the input of passageway 40*a* of second combustion gas conduit 40 communicates the interior of housing 12 and the output of passageway 40*a* through second combustion gas conduit 40 communicates with the input of a passageway through second output conduit 44. First and second conduits 42 and 44, respectively, communicate with each other through gas flow conduit 45, FIG. 5. Vertical wall 46 projects vertically from upper surface 16*a* of wall 16 of housing 12.

Housing 12 further defines first input conduit 48 having a passageway therethrough. The passageway through first input conduit 48 has an input communicating with a first outlet of a fuel demand regulator through a conventional hose. The output of the passageway through first input conduit 48 communicates with passageway 38*a* through first combustion gas conduit 38, and hence, with the input to the passageway through first output conduit 42. Housing 12 further defines second input conduit 52 having a passageway therethrough. The input to the passageway through second input conduit 52 communicates with a second outlet of the fuel demand regulator through a conventional hose. The output of the passageway through second input conduit 52 communicates with passageway 40*a* through second combustion gas conduit 40, and hence, with the input to the passageway through second output conduit 44.

A regulator assembly for controlling the air fuel mixture provided to the engine during exercise of the stand-by electrical generator is generally designated by the reference numeral 70. Regulator assembly 70 includes a L-shaped mounting bracket 62 defined by first and second perpendicular legs 64 and 66, respectively. First leg 64 of mounting bracket 62 includes first and second apertures 68*a* and 68*b*, respectively, therethrough. First and second bolts 70*a* and 70*b*, respectively, extend through first and second apertures 68*a* and 68*b* in first leg 64 of mounting bracket 62 into corresponding first and second apertures 72*a* and 72*b*, respectively, formed in housing 12 so as to interconnect mounting bracket 62 to housing 12.

First and second bolts 74*a* and 74*b*, respectively, extend through second leg 66 of mounting bracket 62 into solenoid 76 so as to interconnect solenoid 76 to mounting bracket 62. Solenoid 76 is electrically coupled to a controller (not shown) by a plurality of wires hereinafter referred to collectively by the reference numeral 78. Solenoid 76 includes plunger 80 movable between an extended position, FIG. 3, and a retracted position, FIG. 4, for reasons hereinafter described. Terminal end 80*a* of plunger 80 of solenoid 76 is operatively connected to a first end 82 of link 84. Second end 86 of link 84 is operatively connected to linkage plate 88.

Figure 5:
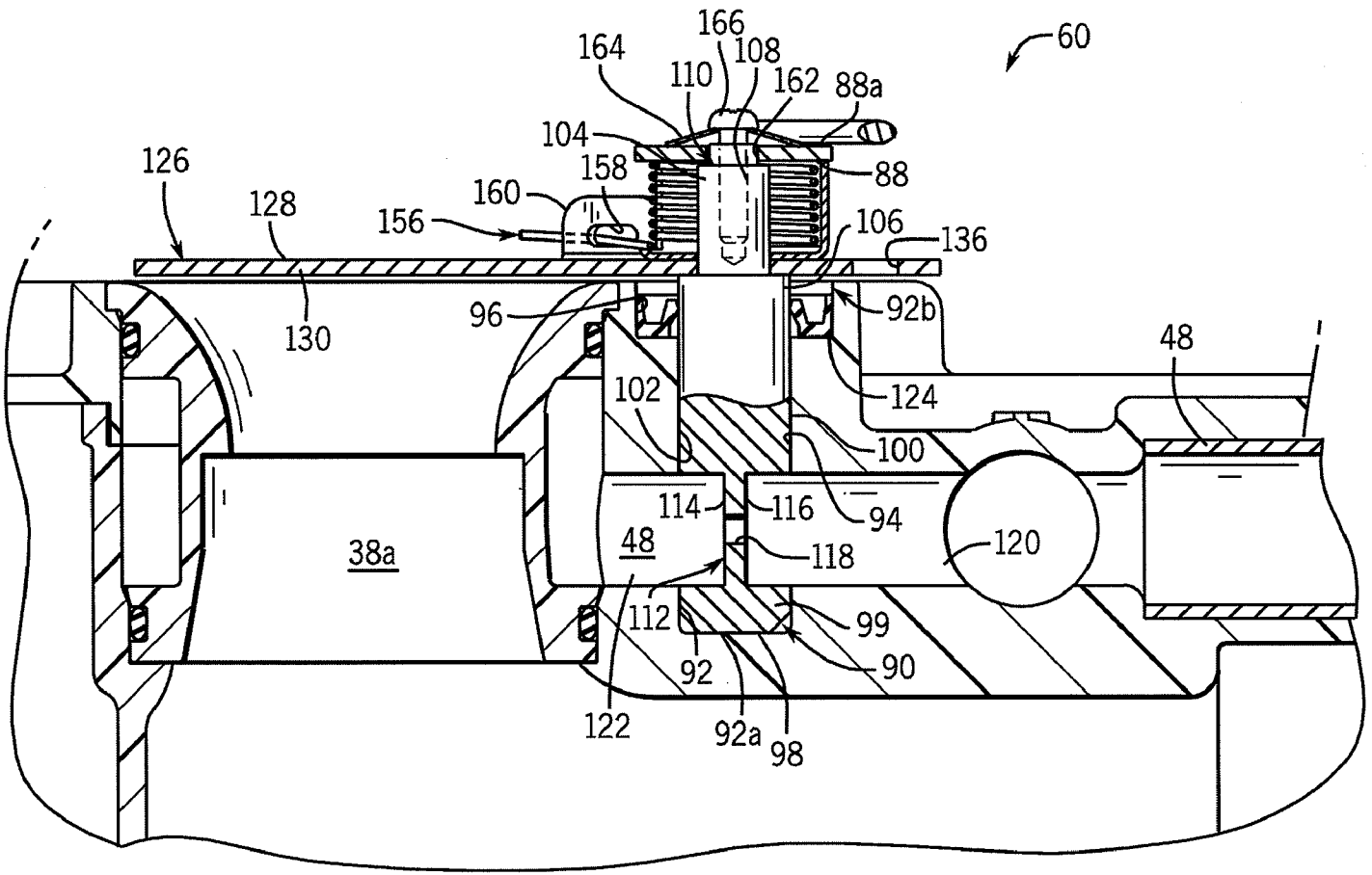
FIG. 5 is cross-sectional view of the fuel mixer box of the present invention taken along line 5-5 of FIG. 3.

Referring to FIGS. 2 and 5, regulator assembly 70 further includes rotatable choke shaft 90 receivable in a corresponding cavity 92 provided in housing 12. Cavity 92 includes a lower closed end 92*a* and a second end 92*b*. Cavity 92 further includes a first portion 94 for having a first diameter and a second portion 96 adjacent opened end 92*b* of cavity 92 having an enlarged diameter. As best seen in FIG. 5, first portion 94 of cavity 92 communicates with the interior of first input conduit 48.

Choke shaft 90 includes a lower end 98 adjacent to the closed end 92*a* of cavity 92 and an outer surface 100 that forms a rotational interface with surface 102 of housing 12 that defines first portion 94 of cavity 92. Choke shaft 90 includes a neck portion 104 projecting from upper end 106 of lower portion 99 of choke shaft 90. Neck portion 104 of choke shaft 90 has a generally rectangular cross section and includes a threaded bore 108 in the upper end 110 thereof, for reasons hereafter described. Lower portion 99 of choke shaft 90 includes a reduced diameter portion 112 defined by first and second recess surfaces 114 and 116, respectively, having a passageway 118 therebetween. For reasons hereinafter described, choke shaft 90 is rotatable between a first position, wherein upstream portion 120 of first input conduit 48 communicates with downstream portion 122 of first input conduit 48 through passageway 118, FIG. 5 and second position wherein upstream 120 of first input conduit 48 communicates with downstream portion 122 of first input conduit 48 along the first and second surfaces 114 and 116, respectively, of reduced diameter portion 112 of choke shaft 90.

Regulator assembly 70 further includes a radial seal 124 having an inner surface engaging outer surface 100 of first portion 99 of choke shaft 90. Seal 124 is seated within enlarged diameter portion 96 of cavity 92 for preventing gaseous fluid from flowing therepast. Choke plate 126 includes upper and lower surfaces 128 and 130, respectively, and a generally rectangular opening 132 therebetween adapted for receiving neck portion 104 of choke shaft 90. Choke plate 126 further includes a generally arcuate opening 136 between upper and lower surfaces 128 and 130, respectively, for guiding movement of choke plate 126, as hereinafter described. Screw 138 extends through opening 136 into a corresponding threaded opening 140 in housing 12. As described, choke plate is movable between a first choke position, FIG. 3, with choke shaft 90 in the first position such that choke 126 overlaps the input of passageway 38*a* of first combustion gas conduit 30*a* and partially overlaps the input of passageway 40*a* through second combustion gas conduit 40 and a second non-choke position, FIG. 4, with choke shaft 90 in the second position wherein choke plate 126 does not interfere with the inputs of passageway 38*a* and 40*a* through corresponding first and second combustion gas conduits 38 and 40, respectively.

Figure 3:
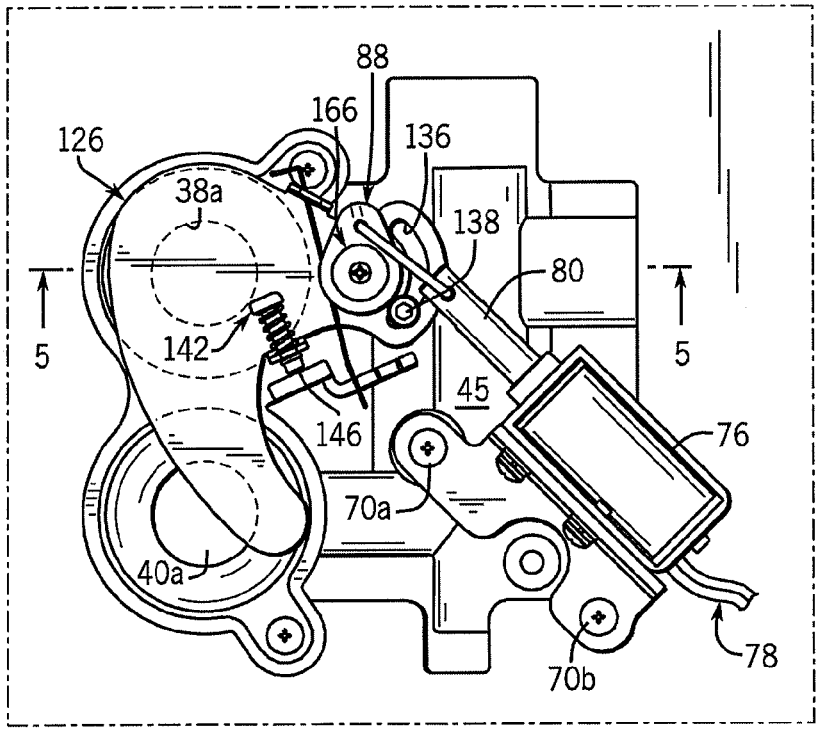
FIG. 3 is an enlarged, top plan view of the fuel mixer box of FIG. 1 with the control device in a first, operating position.

Choke plate 126 further includes adjustment bracket 140 projecting vertically from upper surface 128 thereof. Adjustment bracket 140 includes a threaded aperture therethrough for receiving screw 142. Adjustment spring 144 is positioned about the shaft of screw 142 between adjustment plate 140 and the head thereof. As best seen in FIG. 3, the terminal end 146 of screw 142 engages vertical wall 46 projecting from upper surface 16*a* of wall 16 of housing 12 with choke plate 126 in the choke position. By threading screw 142 into and out of adjustment plate 140, the position of choke plate 126 in the choke position may be adjusted.

Regulator assembly 70 further includes return spring 150 seated in a spring cover 152 and extending about the outer periphery of neck portion 104 of choke shaft 90. Spring 150 is positioned between upper surface 128 of choke plate 126 and lower surface 89 of plate 88. First end 154 of spring 150 is seated within a slot in vertical wall 46 projecting vertically from upper surface 16*a* of lower wall 16 of housing 12 and a second end 156 extending through a slot 158 extending through spring plate 160 projecting vertically from upper surface 128 of choke plate 126. It can be appreciated that spring 150 urges choke plate 126 towards the choke position. Neck portion 104 of choke shaft 90 extends through aperture 162 in plate 88. Spring plate 164 is positioned on upper surface 88*a* of plate 80*a* and screw 166 extends therethrough into threaded aperture 108 in neck portion 104 of choke shaft 90.

Figure 4:
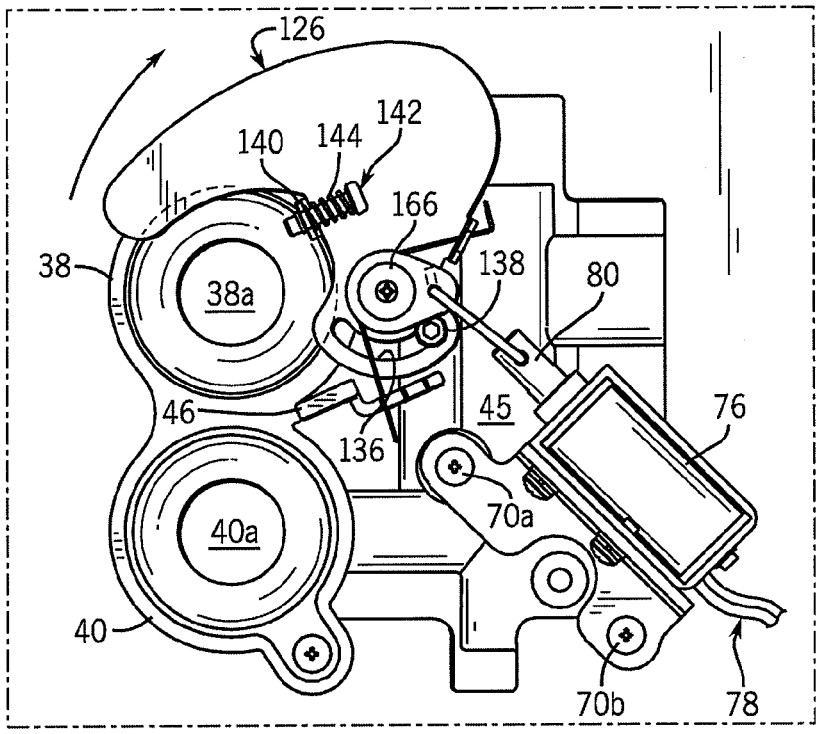
FIG. 4 is an enlarged, top plan view, similar to FIG. 3, with the control device in a second, non-operating position.

Referring to FIG. 4, during normal operation of the stand-by electrical generator, the controller moves plunger 80 of solenoid 76 to its retracted position such that choke plate 126 is in the non-choke position and choke shaft 90 is in the second position. The internal combustion engine of the stand-by electrical generator is started and a vacuum is generated by each cylinder of the engine so as to draw fuel from the fuel demand regulator as hereinafter described. It can be appreciated that during operation of the engine, fuel demand regulator provides a constant source of fuel to first and second combustion gas conduits 38 and 40, respectively, through first and second input conduits 48 and 52, respectively. With choke shaft 90 in the second position, it can be appreciated that the fuel flowing through first input conduit 48 passes freely along the first and second surfaces 114 and 116, respectively, of reduced diameter portion 112 of choke shaft 90. Thereafter, the fuel drawn from the fuel demand regulator into passageway 38*a* through first combustion gas combustion gas conduit 38 mixes with combustion gases supplied to the interior of housing 12 through duct 34 to form a fuel mixture. The fuel mixture in first combustion gas conduit 38 flows through first output conduit 42 and is provided to the first cylinder of the internal combustion engine. Similarly, the fuel drawn from the fuel demand regulator into passageway 40*a* through second combustion gas combustion gas conduit 40 mixes with combustion gases supplied to the interior of housing 12 through duct 34 to form a fuel mixture. The fuel mixture in second combustion gas conduit 40 flows through second output conduit 44 and is provided to the second cylinder of the internal combustion engine.

In order to operate the stand-by electrical generator in an exercise mode, the controller moves plunger 80 of solenoid 76 to its extended position such that choke plate 126 is in the choke position, FIG. 3, and such that choke shaft is in the first position. The internal combustion engine of the stand-by electrical generator is started and a vacuum is generated by each cylinder of the engine so as to draw fuel from the fuel demand regulator as hereinafter described. With choke shaft 90 in the first position, it can be appreciated that the fuel flowing through first input conduit 48 must pass through passageway 118 through reduced diameter portion 112 of choke shaft 90. As a result, the flow of fuel to first combustion gas conduit 38 is substantially reduced. Further, with choke plate 126 in the choke position, FIG. 3, the combustion gases in the interior of housing 12 are prevented from flowing into passageway 38*a* through first combustion gas conduit 38. Likewise, choke plate 126 partially overlaps passageway 40*a* through second combustion gas combustion conduit 40 so as to limit the combustion gases flowing into passageway 40*a* through second combustion gas conduit 40. As such, the fuel drawn from the fuel demand regulator into passageway 40*a* through second combustion gas conduit 40 mixes with combustion gases that flow into passageway 40*a* of second combustion gas conduit 40 to form a fuel mixture. The fuel mixture in second combustion gas conduit 40 mixes with the fuel drawn into first combustion gas conduit 38 within gas flow conduit 45 so as to provide a balanced fuel mixture to the first and second cylinders of the internal combustion engine through output conduits 42 and 44, respectively. It can be understood that by limiting the volume of the fuel mixture provided to the first and second cylinders of the internal combustion engine, the engine has the ability to run balanced at lower, exercise speeds. It is also noted that with choke shaft 90 in the first position, regulator assembly 70 acts as a traditional choke system for the starting of the engine at all temperature ranges.

It is noted that the size of passageway 118 through reduced diameter portion 112 of choke shaft 90 may be enlarged to vary the fluid flow through passageway 118 with the stand-by electrical generator in the exercise mode. Further, as heretofore described, by threading screw 142 into and out of adjustment plate 140, the position of choke plate 126 in the choke position may be adjusted. This, in turn, allows a user to tune the volume of combustion gases that enter passageways 38*a* and 40*a* of corresponding first and second combustion gas conduits 38 and 40, respectively.

Various modes of carrying out the invention are contemplated as being within the scope of the following claims particularly pointing out and distinctly claiming the subject matter which is regarded as the invention.

We claim:

1. A device for balancing a fuel mixture provided to each cylinder of an engine during exercise of the engine, comprising:

first and second input conduits having inputs connectable to a fuel source for receiving fuel therefrom and outputs;

first and second output conduit having inputs communicating with the outputs of corresponding first and second input conduits and outputs connectable to corresponding cylinders of the engine;

a housing having an interior and an opening therein for allowing air to enter the housing, the housing including:

a first fuel mixture chamber interconnecting the output of the first input conduit and the input of the first output conduit, the first fuel mixture chamber having an input communicating with the interior of the housing; and a second fuel mixture chamber interconnecting the output of the second input conduit and the input of the second output conduit, the second fuel mixture chamber having an input communicating with the interior of the housing; and a balancing device positioned in the housing for selectively controlling the flow of air from the interior of the housing into the first fuel mixture chamber.

2. The fuel mixer box of claim 1 wherein the balancing device selectively controls the fuel flowing in at least one of the first and second input conduits.

3. The fuel mixer box of claim 1 wherein the balancing device includes:

a valve plate pivotably mounted within the housing, the valve plate movable between a first open position and a second exercise position wherein the valve plate overlaps at least a portion of the input of the first fuel mixture chamber.

4. The fuel mixer box of claim 3 further comprising a rotatable shaft operatively connected to the valve plate and extending into the first input conduit, the shaft movable between a first open position for allowing a first volume of fuel to flow therepast and a second exercise position for allowing a second volume of fuel to therepast, wherein the first volume is greater than the second volume.

5. The fuel mixer box of claim 4 wherein the shaft includes an aperture therethrough, wherein the fuel flows around the shaft with shaft in the open position and wherein the fuel flows through the aperture in the shaft with the shaft in the exercise position.

6. The fuel mixer box of claim 3 further comprising a solenoid having a extendable plunger operatively connected to the valve plate for moving the valve plate, the solenoid movable between a first retracted position to maintain the valve plate in the open position and an extended position for maintaining the valve plate in the exercise position.

7. The fuel mixer box of claim 3 further comprising an adjustment device operatively connected to the valve plate for setting the exercise position of valve device.

8. The fuel mixer box of claim 7 further comprising a stop plate projecting into the interior of the housing and wherein the adjustment device includes:

a support projecting from the valve plate, the support having a threaded aperture therethrough; and a screw extending through the threaded aperture and including a shaft having a terminal end, the terminal end of the shaft engaging the stop plate so as to define the exercise position of the valve plate.

9. The fuel mixer box of claim 1 wherein the first and second fuel mixture chambers communicate.

10. A fuel mixer box for balancing a fuel mixture provided to each cylinder of an engine during exercise of the engine, comprising:

a first input conduit having an input connectable to a fuel source for receiving fuel therefrom and an output;

a first output conduit having an input communicating with the output of the first input conduit and an output connectable to a first cylinder of the engine;

a second input conduit having an input connectable to the fuel source for receiving fuel therefrom and an output;

a second output conduit having an input communicating with the output of the second input conduit and an output connectable to a second cylinder of the engine;

a housing defining an inner chamber and an opening therein for receiving air, the housing including:

a first fuel mixture chamber interconnecting the output of the first input conduit and the input of the first output conduit, the first fuel mixture chamber having an input communicating with the inner chamber of the housing; and a second fuel mixture chamber interconnecting the output of the second input conduit and the input of the second output conduit, the second fuel mixture chamber having an input communicating with the inner chamber of the housing;

a valve plate pivotably mounted within the housing, the valve plate movable between a first open position and a second exercise position wherein the valve plate overlaps at least a portion of the input of the first fuel mixture chamber; and a fuel control element extending into the first input conduit, the fuel control element movable between a first open position for allowing a first volume of fuel to flow therepast and a second exercise position for allowing a second volume of fuel to therepast.

11. The fuel mixer box of claim 10 wherein the fuel control element is operatively connected to the valve plate for pivotable movement therewith.

12. The fuel mixer box of claim 10 wherein the fuel control element includes a rotatable shaft operatively connected to the valve plate and having an aperture therethrough, wherein the fuel flows around the shaft with the fuel control element in the open position and wherein the fuel flows through the aperture in the shaft with the fuel control element in the exercise position.

13. The fuel mixer box of claim 10 further comprising a solenoid having a extendable plunger operatively connected to the valve plate for pivoting the valve plate, the solenoid movable between a first retracted position to maintain the valve plate in the open position and an extended position for maintaining the valve plate in the exercise position.

14. The fuel mixer box of claim 10 further comprising an adjustment device operatively connected to the valve plate for defining the exercise position of the valve device.

15. The fuel mixer box of claim 10 further comprising a stop plate projecting into the interior of the housing and wherein the adjustment device includes:

a support projecting from the valve plate, the support having a threaded aperture therethrough; and a screw extending through the threaded aperture and including a shaft having a terminal end, the terminal end of the shaft engaging the stop plate so as to define the exercise position of the valve plate.

16. The fuel mixer box of claim 10 wherein the first and second fuel mixture chambers communicate.

17. A method for exercising an engine having a plurality of cylinders at a predetermined speed less than the normal operating speed of the engine, each cylinder receiving an air-fuel mixture having an air component and a fuel component, comprising the steps of:

reducing the air component and the fuel component in the air-fuel mixture; and balancing the volume of the air-fuel mixture provided to each cylinder of the engine.

18. The method of claim 17 wherein the step of reducing the air component comprising the steps of:

providing an input having a cross-sectional area for receiving the air component of the air-fuel mixture; and reducing the cross-sectional area of the input.

19. The method of claim 18 wherein the step of reducing the cross-sectional area of the input includes the steps of:

providing a valve plate, the valve plate in a non-interfering relationship with the input of the engine; and pivoting the valve plate to an exercise position wherein the valve plate overlaps at least a portion of the input.

20. The method of claim 19 comprising the additional step of adjusting the exercise position of the valve plate.

21. The method of claim 17 wherein the step of reducing the fuel component comprising the steps of:

providing an input having a cross-sectional area for receiving the fuel component of the air-fuel mixture; and reducing the cross-sectional area of the input.

22. The method of claim 21 wherein the input for the fuel is defined by a fuel conduit having a passageway with a cross-sectional area and wherein the step of reducing the cross-sectional area of the input includes the steps of:

providing a fuel control element in the fuel conduit;

rotating the fuel control element to an exercising position to reduce the cross-sectional area of the passageway.

* * * * *